US011851845B2

(12) United States Patent
Erhardt et al.

(10) Patent No.: US 11,851,845 B2
(45) Date of Patent: Dec. 26, 2023

(54) IMPLEMENT CARRIER

(71) Applicant: Clark Equipment Company, West Fargo, ND (US)

(72) Inventors: Cody Erhardt, Bismarck, ND (US); Jonathan J. Roehrl, Bismarck, ND (US)

(73) Assignee: DOOSAN BOBCAT NORTH AMERICA INC., West Fargo, ND (US)

( * ) Notice: Subject to any disclaimer, the term of this patent is extended or adjusted under 35 U.S.C. 154(b) by 0 days.

(21) Appl. No.: 16/177,845

(22) Filed: Nov. 1, 2018

(65) Prior Publication Data

US 2019/0127954 A1 May 2, 2019

Related U.S. Application Data

(60) Provisional application No. 62/580,185, filed on Nov. 1, 2017.

(51) Int. Cl.
*E02F 9/20* (2006.01)
*E02F 3/36* (2006.01)
(Continued)

(52) U.S. Cl.
CPC ..... *E02F 9/2025* (2013.01); *E02F 3/3604* (2013.01); *E02F 3/364* (2013.01);
(Continued)

(58) Field of Classification Search
CPC ..... E02F 9/2025; E02F 3/3604; E02F 3/3627; E02F 3/364; E02F 3/3668; E02F 3/3672;
(Continued)

(56) References Cited

U.S. PATENT DOCUMENTS 2,589,896 A * 3/1952 Toland ..... A01B 63/32 116/285
4,963,071 A * 10/1990 Larwin ..... E02F 3/3631 172/272
(Continued)

FOREIGN PATENT DOCUMENTS

DE 202013102986 U1 10/2014
DE 202013102986 * 11/2014
(Continued)

OTHER PUBLICATIONS

International Search Report and Written Opinion dated Mar. 6, 2019 for International Application No. PCT/US2018/058678 filed Nov. 1, 2018, 13 pages.
(Continued)

*Primary Examiner* — Angelina Shudy
*Assistant Examiner* — Mohamed Abdo Algehaim
(74) *Attorney, Agent, or Firm* — John Veldhuis-Kroeze; Westman, Champlin & Koehler, P.A.

(57) ABSTRACT

Power machines with implement carriers that can sense the proximity of an implement to the implement carrier with a plurality of sensors. Such sensing is indicative of the likelihood of an implement being positioned adjacent to the implement carrier. In some embodiments, a sensor detects whether a locking mechanism is activated.

12 Claims, 12 Drawing Sheets

(51) Int. Cl.
*E02F 9/26* (2006.01)
*E02F 3/34* (2006.01)

(52) U.S. Cl.
CPC ..... *E02F 3/3627* (2013.01); *E02F 3/3668* (2013.01); *E02F 3/3672* (2013.01); *E02F 9/264* (2013.01); *E02F 9/267* (2013.01); *E02F 3/3414* (2013.01)

(58) Field of Classification Search
CPC ..... E02F 9/264; E02F 9/267; E02F 3/3414; E02F 3/00–3/968; E02F 9/00–9/2891
USPC ..... 701/50
See application file for complete search history.

(56) References Cited

U.S. PATENT DOCUMENTS 5,010,962 A * 4/1991 Bloom, Jr. ..... E02F 3/3604 116/281
5,467,542 A * 11/1995 Hulden ..... E02F 3/365 37/468
5,562,397 A * 10/1996 Albright ..... E02F 3/364 37/468
5,692,850 A * 12/1997 Kimble ..... B66F 9/12 172/273
5,692,855 A * 12/1997 Burton ..... E02F 3/3631 172/272
5,727,342 A * 3/1998 Horton ..... E02F 3/3622 37/468
5,966,850 A 10/1999 Horton
RE37,320 E 8/2001 Horton
RE37,339 E 8/2001 Horton
6,349,959 B2 * 2/2002 Schlegel ..... A01B 59/006 116/284
6,390,765 B1 * 5/2002 Dick ..... E02F 3/3627 37/468
6,422,805 B1 * 7/2002 Miller ..... E02F 3/3618 37/468
6,619,906 B2 * 9/2003 Dick ..... E02F 3/3627 37/468
6,625,909 B1 * 9/2003 Miller ..... E02F 3/3618 37/468
6,699,001 B2 * 3/2004 Fatemi ..... E02F 3/3618 37/468
6,962,475 B2 11/2005 Fatemi
7,467,918 B2 * 12/2008 Yao ..... E02F 3/3663 37/468
8,549,775 B2 * 10/2013 Lanting ..... E02F 3/3631 37/468
10,590,631 B2 * 3/2020 Keighley ..... E02F 3/3663
10,711,429 B2 * 7/2020 Webb ..... E02F 3/3663
10,731,318 B2 8/2020 Seacat et al.
10,895,057 B2 * 1/2021 Hill ..... E02F 3/3622
2005/0193603 A1 * 9/2005 Schultz ..... E02F 3/7627 37/417
2008/0201043 A1 * 8/2008 Sahlin ..... E02F 3/847 701/50
2012/0189374 A1 * 7/2012 Lanting ..... E02F 3/3672 403/27
2012/0237292 A1 * 9/2012 Seda ..... E02F 3/3636 403/376
2014/0064824 A1 * 3/2014 Nilsson ..... E02F 3/3627 403/27
2014/0317967 A1 * 10/2014 Parker ..... E02F 3/3627 37/403
2015/0176254 A1 * 6/2015 Blakeman ..... E02F 3/3618 701/50
2015/0225923 A1 * 8/2015 Wallace ..... E02F 9/264 701/50
2015/0233084 A1 * 8/2015 Seljestad ..... B66F 9/12 414/723
2015/0240456 A1 * 8/2015 Jonsson ..... E02F 3/3627 701/50
2016/0033989 A1 * 2/2016 Villarreal ..... G05G 5/08 74/470
2016/0157428 A1 * 6/2016 Pitzer ..... A01D 46/30 701/50
2017/0254049 A1 * 9/2017 Kean ..... G01P 15/18
2017/0328026 A1 * 11/2017 Martin ..... E02F 3/3672
2017/0335540 A1 * 11/2017 Hill ..... E02F 3/3609
2018/0066418 A1 * 3/2018 Keighley ..... E02F 3/3627
2018/0223504 A1 * 8/2018 Gonzalez ..... E02F 3/431
2018/0238015 A1 * 8/2018 Fey ..... E02F 9/265
2018/0238016 A1 * 8/2018 Seacat ..... E02F 3/7613
2018/0255707 A1 * 9/2018 Solimar Walter ..... E02F 3/3663
2019/0234044 A1 * 8/2019 Nygren ..... E02F 3/627
2022/0325502 A1 * 10/2022 Hobbs ..... E02F 3/435
2023/0304255 A1 * 9/2023 Oasa ..... E02F 9/261 701/50

FOREIGN PATENT DOCUMENTS

EP 3 363 955 A3 8/2018
WO 2012156672 A1 11/2012
WO WO 2012/156672 * 11/2012
WO 2015060730 A1 4/2015

OTHER PUBLICATIONS

Communication pursuant to Article 94(3) EPC for European patent application No. 18 807 787.9, dated Mar. 2, 2023, 8 pages.

* cited by examiner

IMPLEMENT CARRIER

CROSS-REFERENCE TO RELATED APPLICATION

This application claims the benefit of U.S. Provisional Application No. 62/580,185, which was filed on Nov. 1, 2017.

BACKGROUND

The present disclosure is directed toward power machines. More particularly, the present disclosure is related to implement carriers on power machines to which implements can be removably coupled.

Power machines, for the purposes of this disclosure, include any type of machine that generates power for the purpose of accomplishing a particular task or a variety of tasks. One type of power machine is a work vehicle. Work vehicles, such as loaders, are generally self-propelled vehicles that have a work device, such as a lift arm (although some work vehicles can have other work devices) that can be manipulated to perform a work function. Work vehicles include loaders, excavators, utility vehicles, tractors, and trenchers, to name a few examples.

Many power machines have implement carriers to which various types of implements can be removably coupled. For example, various compact loaders have an implement carrier rotatably coupled to a lift arm for receiving various implements. Such implement carriers advantageously allow an operator to use various implements on a single machine and quickly change implements as may be desired. In addition, some loaders have the capability to allow an operator to couple and decouple implements from an implement carrier in response to operator inputs without requiring an operator to leave an operator compartment.

However, in some instances, due, for example to misalignment of an implement during the coupling process to improperly couple an implement to an implement carrier. It would be advantageous for an operator to know when an implement is properly coupled to an implement carrier.

The discussion above is merely provided for general background information and is not intended to be used as an aid in determining the scope of the claimed subject matter.

SUMMARY

This Summary and the Abstract are provided to introduce a selection of concepts in a simplified form that are further described below in the Detailed Description. The summary and the abstract are not intended to identify key features or essential features of the claimed subject matter, nor are they intended to be used as an aid in determining the scope of the claimed subject matter.

The disclosed embodiments illustrate systems and methods for sensing the proximity of an implement relative an implement carrier in a loader.

Disclosed embodiments include method of sensing a position of an implement (456) relative to an implement carrier (400; 400-1) of a power machine to which the implement can be attached. The method includes determining (502; 602) whether a first sensor (424) of an implement sensing system (378) detects the implement (456) near a first position on the implement carrier; providing (506; 606) an indication to the control system of the first sensor sensing proximity of the implement near the first position on the implement carrier if it is determined that the first sensor detects the implement near the first position; determining (508; 608) whether a second sensor (426) of the implement sensing system detects the implement near a second position on the implement carrier; providing (510; 610) an indication to the control system of the second sensor sensing proximity of the implement near the second position on the implement carrier if it is determined that the second sensor detects the implement near the second position; determining (512; 612), if the second sensor detected the implement near the second position, whether a locking mechanism sensor (466; 474; 476) of the implement sensing system detects a locking mechanism in an activated position; and providing (514; 615) an indication to the control system of whether the locking mechanism is activated and controlling the power machine based upon the indication of whether the locking mechanism is activated.

In some exemplary embodiments of the method, determining (502; 602) whether the first sensor (424) of the implement sensing system (378) detects the implement (456) near the first position on the implement carrier further comprises determining whether the first sensor detects the implement near a first engagement feature (412; 414) on the implement carrier. Further in some embodiments, determining whether the first sensor detects the implement near the first engagement feature (412; 414) on the implement carrier comprises determining whether the first sensor detects the implement near the first engagement feature at a top of the implement carrier that is configured to engage a complementary feature (458) on the implement that can be sensed by the first sensor (424).

In some exemplary embodiments, determining (508; 608) whether the second sensor (426) of the implement sensing system detects the implement near the second position on the implement carrier further comprises determining whether the second sensor detects the implement near the second position near a bottom of the implement carrier.

In some exemplary embodiments, determining (512; 612) whether the locking mechanism sensor (466) of the implement sensing system detects the locking mechanism in an activated position comprises sensing whether a handle (420; 422) of the implement carrier is in a position that moves a coupled pin (416; 418) of the implement carrier to an extended position.

In some embodiments, determining (512; 612) whether the locking mechanism sensor (474; 476) of the implement sensing system detects the locking mechanism in an activated position comprises sensing whether a position or state of an actuator (470; 472) coupled to a handle (420; 422) of the implement carrier is indicative of a handle position that moves a coupled pin (416; 418) of the implement carrier to an extended position.

In another exemplary embodiment, a power machine is provided. The power machine comprises: a frame (110; 210; 310); a power system (120; 220) configured to provide power for operating functions on the power machine; a traction system (140; 240) coupled to the frame and configured to move the power machine over a support surface; a lift arm structure (130; 230; 330) pivotally coupled to the frame and configured to be moved relative to the frame by at least one lift arm actuator (238; 332); an implement carrier (170; 270; 370; 400; 400-1) pivotally coupled to the lift arm structure and configured to be rotated relative to the lift arm structure by at least one implement carrier actuator (334); a control system (160; 360) coupled to the power system and configured to control the provision of power from the power system, the control system including a controller (362) and a human machine interface (364); and an implement sensing system (378) coupled to the control system and configured to sense whether an implement (456) is in close enough proximity to the implement carrier that it can be operably coupled to the implement carrier and to provide indications to the control system, the control system configured to control the power machine based upon the indications from the implement sensing system.

In some exemplary embodiments of the power machine, the implement carrier includes an engagement feature (372; 412; 414) for engaging the implement while and after the implement is being coupled to the implement carrier, a locking feature (374; 416; 418) that is moveable between an unlocked position and a locked position to, along with the engagement feature, secure the implement to the implement carrier, and a locking mechanism (376; 420; 422) operable to move the locking feature between the unlocked and the locked position.

In some exemplary embodiments of the power machine, the implement sensing system (378) includes a first sensor (424) positioned adjacent the engagement feature of the implement carrier. Further, in some embodiments, the implement sensing system is further configured to: determine (502; 602) whether the first sensor detects the implement near the engagement feature on the implement carrier; and provide (506; 606) an indication to the control system of the first sensor sensing proximity of the implement near the engagement feature if it is determined that the first sensor does detect the implement near the first position.

In some exemplary embodiments of the power machine, the implement sensing system includes a second sensor (426) and is further configured to: determine (508; 608) whether the second sensor (426) detects the implement near a second position on the implement carrier; and provide (510; 610) an indication to the control system of the second sensor sensing proximity of the implement near the second position on the implement carrier if it is determined that the second sensor detects the implement near the second position.

In some exemplary embodiments of the power machine, the implement sensing system further includes a locking mechanism sensor (466; 474; 476) and is further configured to: determine (512; 612), if the second sensor detected the implement near the second position, whether the locking mechanism sensor detects the locking mechanism (376; 420; 422) in an activated position; and provide (514; 615) an indication to the control system of whether the locking mechanism is activated.

In some exemplary embodiments of the power machine, the engagement feature on the implement carrier comprises a feature near a top of the implement carrier that is configured to engage a complimentary feature on the implement.

In some exemplary embodiments of the power machine, the second position on the implement carrier is a position near a bottom of the implement carrier.

The features of the various disclosed embodiments can be included in differing combinations.

DETAILED DESCRIPTION

The concepts disclosed in this discussion are described and illustrated with reference to exemplary embodiments. These concepts, however, are not limited in their application to the details of construction and the arrangement of components in the illustrative embodiments and are capable of being practiced or being carried out in various other ways. The terminology in this document is used for description and should not be regarded as limiting. Words such as "including," "comprising," and "having" and variations thereof as used herein are meant to encompass the items listed thereafter, equivalents thereof, as well as additional items.

Disclosed are implement carriers and power machines with implement carriers having an engagement detection system for determining whether an implement is in position to be coupled to the implement carrier. These engagement systems, in some embodiments, can signal to an operator whether the implement is in a proper position relative to the implement carrier to assist in determining whether the implement is properly coupled to the implement carrier.

Figure 2:
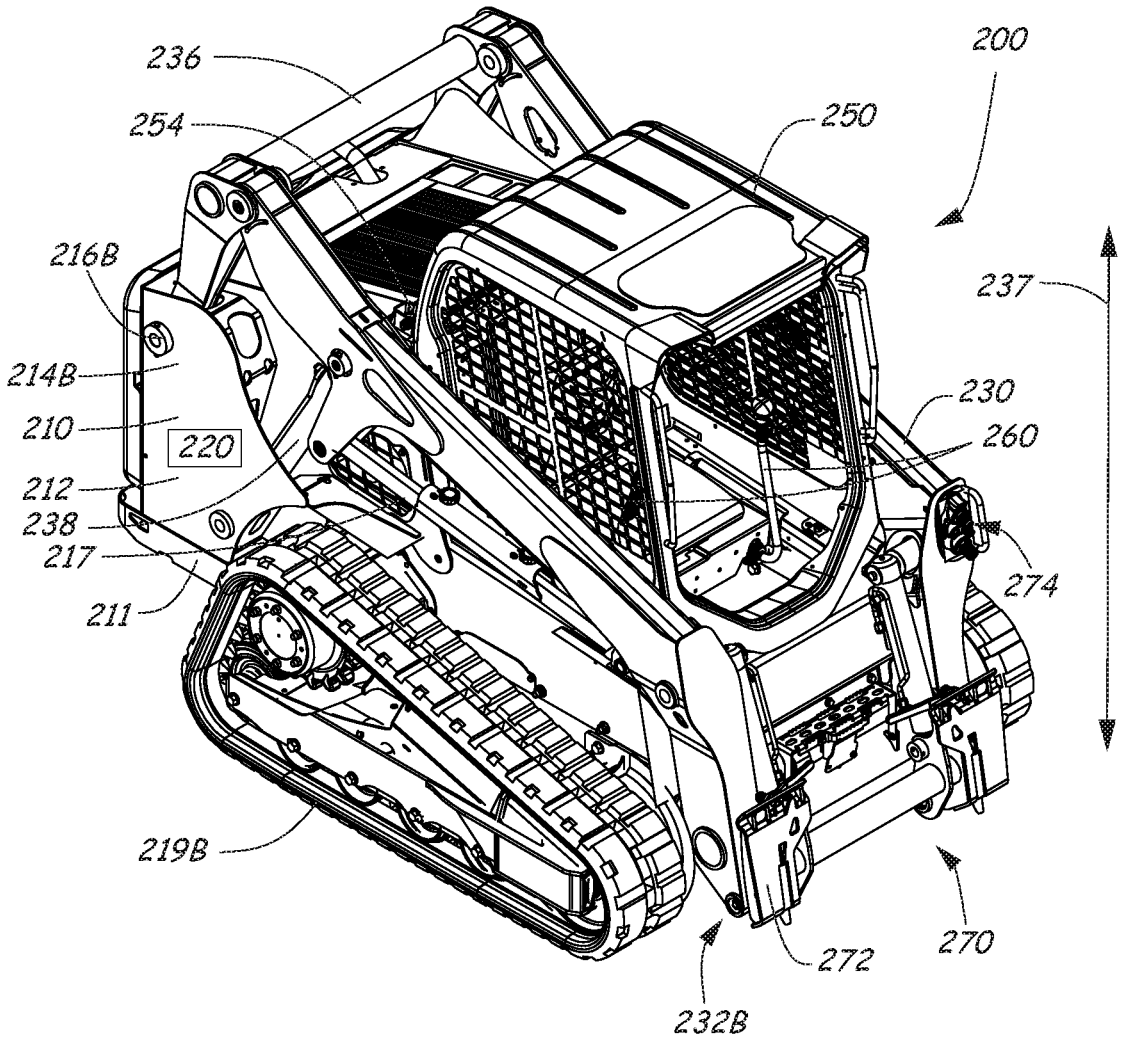
FIG. 2 is a front perspective view of a power machine on which embodiments disclosed in this specification can be advantageously practiced.
Figure 3:
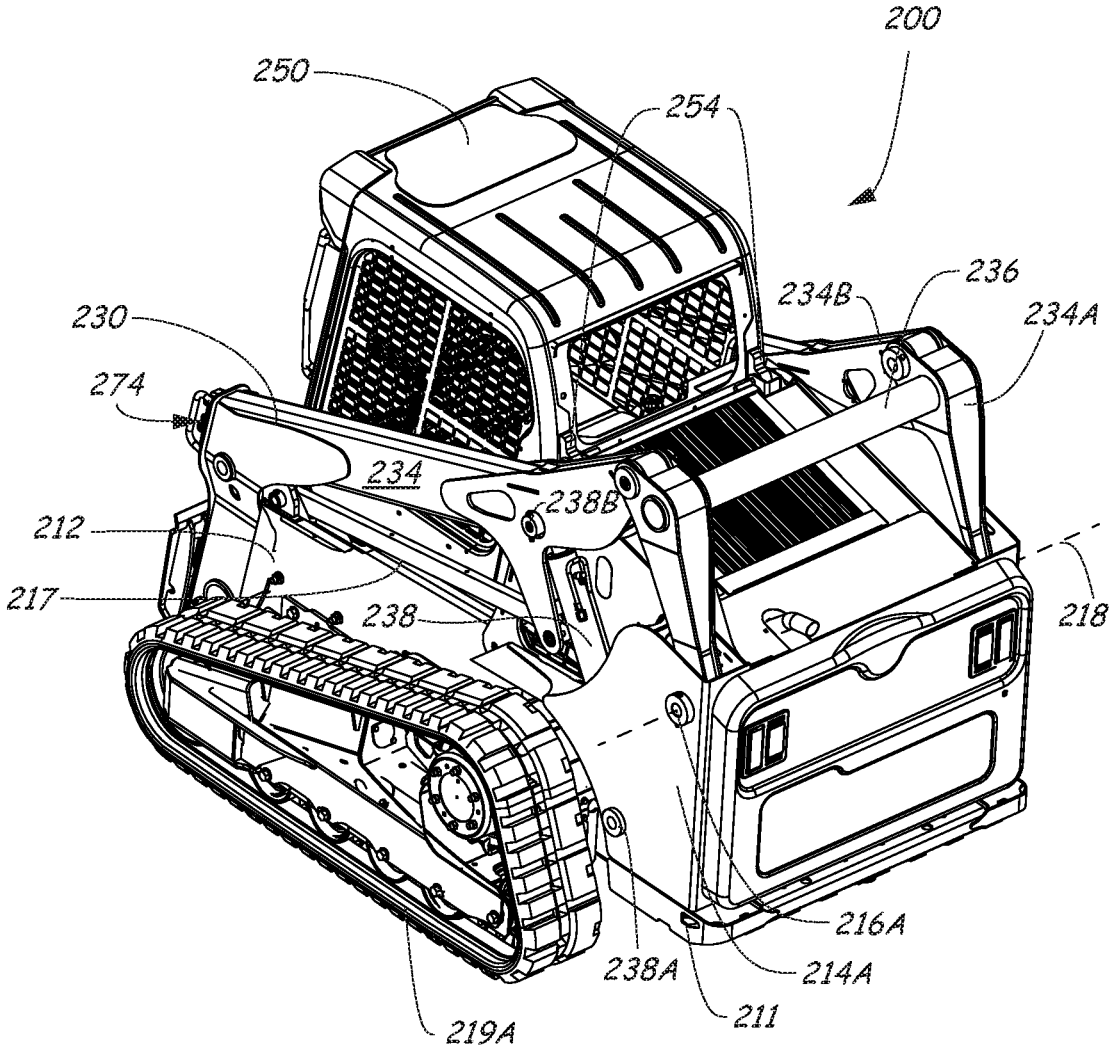
FIG. 3 is a rear perspective view of the power machine shown in FIG. 2.

These features, and the more general concepts, can be practiced on various power machines, as will be described below. A representative power machine on which the embodiments can be practiced is illustrated in diagram form in FIG. 1 and one example of such a power machine is illustrated in FIGS. 2-3 and described below before any embodiments are disclosed. For the sake of brevity, only one power machine is discussed. However, as mentioned above, the embodiments below can be practiced on any of a number of power machines, including power machines of different types from the representative power machine shown in FIGS. 2-3. Power machines, for the purposes of this discussion, include a frame, at least one work element, and a power source that can provide power to the work element to accomplish a work task. One type of power machine is a self-propelled work vehicle. Self-propelled work vehicles are a class of power machines that include a frame, work element, and a power source that can provide power to the work element. At least one of the work elements is a motive system for moving the power machine under power.

Figure 1:
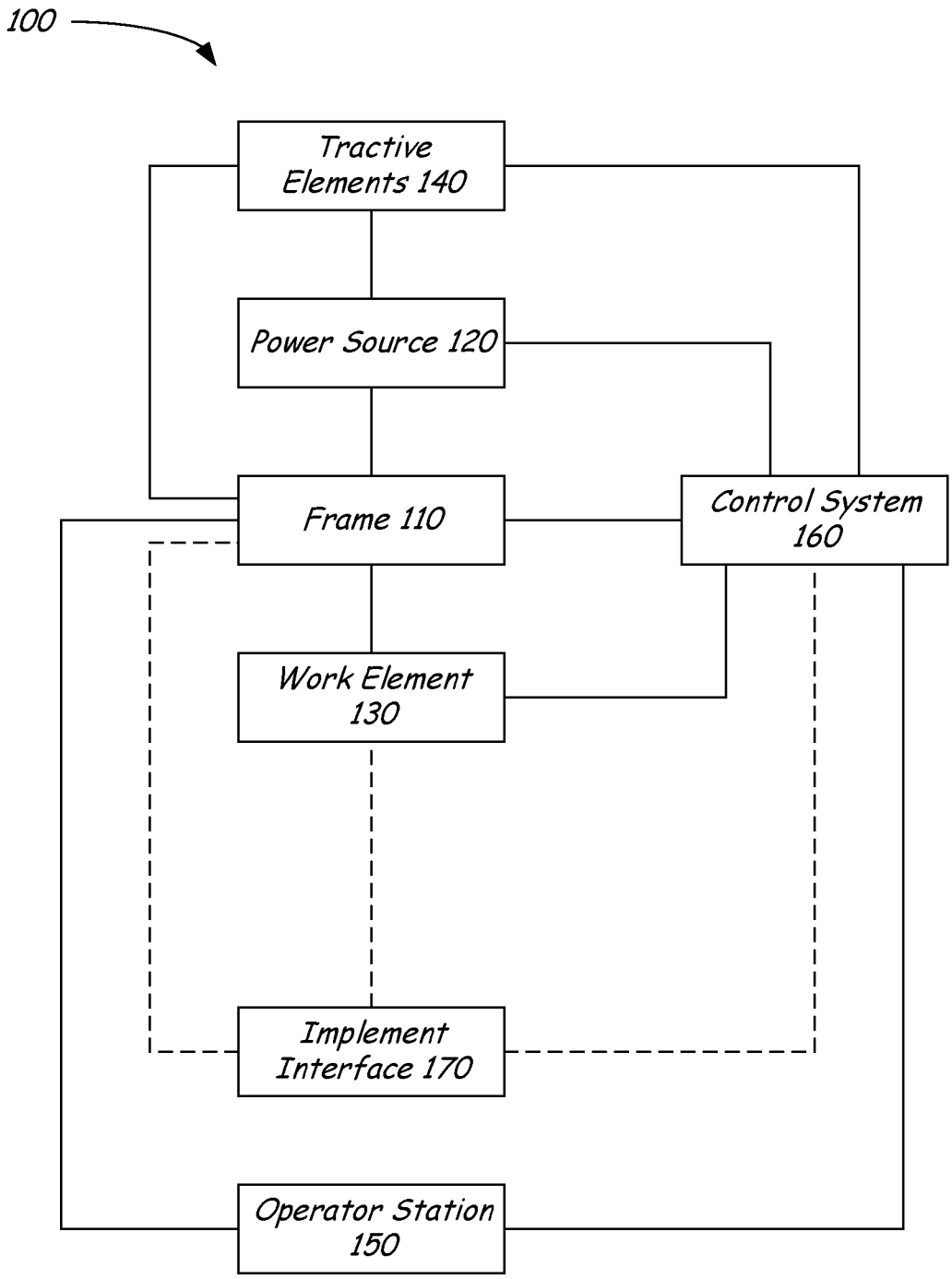
FIG. 1 is a block diagram illustrating functional systems of a representative power machine on which embodiments of the present disclosure can be advantageously practiced.

FIG. 1 illustrates a block diagram illustrates the basic systems of a power machine 100 upon which the embodiments discussed below can be advantageously incorporated and can be any of a number of different types of power machines. The block diagram of FIG. 1 identifies various systems on power machine 100 and the relationship between various components and systems. As mentioned above, at the most basic level, power machines for the purposes of this discussion include a frame, a power source, and a work element. The power machine 100 has a frame 110, a power source 120, and a work element 130. Because power machine 100 shown in FIG. 1 is a self-propelled work vehicle, it also has tractive elements 140, which are themselves work elements provided to move the power machine over a support surface and an operator station 150 that provides an operating position for controlling the work elements of the power machine. A control system 160 is provided to interact with the other systems to perform various work tasks at least in part in response to control signals provided by an operator.

Certain work vehicles have work elements that can perform a dedicated task. The work element, i.e., the lift arm can be manipulated to position an implement for performing the task. The implement, in some instances can be positioned relative to the work element, such as by rotating a bucket relative to a lift arm, to further position the implement. Many work vehicles are intended to be used with a wide variety of implements and have an implement interface such as implement interface 170 shown in FIG. 1. At its most basic, implement interface 170 is a connection mechanism between the frame 110 or a work element 130 and an implement, which can be as simple as a connection point for attaching an implement directly to the frame 110 or a work element 130 or more complex, as discussed below.

On some power machines, implement interface 170 can include an implement carrier, which is a physical structure movably attached to a work element. The implement carrier has engagement features and locking features to accept and secure any of a number of implements to the work element. One characteristic of such an implement carrier is that once an implement is attached to it, it is fixed to the implement (i.e. not movable with respect to the implement) and when the implement carrier is moved with respect to the work element, the implement moves with the implement carrier. The term implement carrier as used herein is not merely a pivotal connection point, but rather a dedicated device specifically intended to accept and be secured to various different implements. The implement carrier itself is mountable to a work element 130 such as a lift arm or the frame 110. Implement interface 170 can also include one or more power sources for providing power to one or more work elements on an implement. Some power machines can have a plurality of work element with implement interfaces, each of which may, but need not, have an implement carrier for receiving implements. Some other power machines can have a work element with a plurality of implement interfaces so that a single work element can accept a plurality of implements simultaneously. Each of these implement interfaces can, but need not, have an implement carrier.

Frame 110 includes a physical structure that can support various other components that are attached thereto or positioned thereon. The frame 110 can include any number of individual components. Some power machines have frames that are rigid. That is, no part of the frame is movable with respect to another part of the frame. Other power machines have at least one portion that can move with respect to another portion of the frame. For example, excavators can have an upper frame portion that rotates with respect to a lower frame portion. Other work vehicles have articulated frames such that one portion of the frame pivots with respect to another portion for accomplishing steering functions.

Frame 110 supports the power source 120, which can provide power to one or more work elements 130 including the one or more tractive elements 140, as well as, in some instances, providing power for use by an attached implement via implement interface 170. Power from the power source 120 can be provided directly to any of the work elements 130, tractive elements 140, and implement interfaces 170. Alternatively, power from the power source 120 can be provided to a control system 160, which in turn selectively provides power to the elements that capable of using it to perform a work function. Power sources for power machines typically include an engine such as an internal combustion engine and a power conversion system such as a mechanical transmission or a hydraulic system that can convert the output from an engine into a form of power that is usable by a work element. Other types of power sources can be incorporated into power machines, including electrical sources or a combination of power sources, known generally as hybrid power sources.

FIG. 1 shows a single work element designated as work element 130, but various power machines can have any number of work elements. Work elements are typically attached to the frame of the power machine and movable with respect to the frame when performing a work task. In addition, tractive elements 140 are a special case of work element in that their work function is generally to move the power machine 100 over a support surface. Tractive elements 140 are shown separate from the work element 130 because many power machines have additional work elements besides tractive elements, although that is not always the case. Power machines can have any number of tractive elements, some, or all of which can receive power from the power source 120 to propel the power machine 100. Tractive elements can be, for example, track assemblies, wheels attached to an axle, and the like. Tractive elements can be mounted to the frame such that movement of the tractive element is limited to rotation about an axle (so that steering is accomplished by a skidding action) or, alternatively, pivotally mounted to the frame to accomplish steering by pivoting the tractive element with respect to the frame. In example embodiments described below, tractive elements include track frame assemblies which are mounted to frame 110 using exemplary mounting structures and techniques.

Power machine 100 includes an operator station 150 that includes an operating position from which an operator can control operation of the power machine. In some power machines, the operator station 150 is defined by an enclosed or partially enclosed cab. Some power machines on which the disclosed embodiments may be practiced may not have a cab or an operator compartment of the type described above. For example, a walk behind loader may not have a cab or an operator compartment, but rather an operating position that serves as an operator station from which the power machine is properly operated. More broadly, power machines other than work vehicles may have operator stations that are not necessarily similar to the operating positions and operator compartments referenced above. Further, some power machines such as power machine 100 and others, whether or not they have operator compartments or operator positions, may be capable of being operated remotely (i.e. from a remotely located operator station) instead of or in addition to an operator station adjacent or on the power machine. This can include applications where at least some of the operator-controlled functions of the power machine can be operated from an operating position associated with an implement that is coupled to the power machine. Alternatively, with some power machines, a remote-control device can be provided (i.e. remote from both the power machine and any implement to which is it coupled) that is capable of controlling at least some of the operator-controlled functions on the power machine.

FIGS. 2-3 illustrates a loader 200, which is one particular example of a power machine of the type illustrated in FIG. 1 where the embodiments discussed below can be advantageously employed. Loader 200 is a track loader and more particularly, a compact tracked loader. A track loader is a loader that has endless tracks as tractive elements (as opposed to wheels). Other loaders can have wheels instead of tracks. Track loader 200 is one particular example of the power machine 100 illustrated broadly in FIG. 1 and discussed above. To that end, features of loader 200 described below include reference numbers that are generally similar to those used in FIG. 1. For example, loader 200 is described as having a frame 210, just as power machine 100 has a frame 110. Track loader 200 is described herein to provide a reference for understanding one environment on which the embodiments described below related to track assemblies and mounting elements for mounting the track assemblies to a power machine may be practiced. The loader 200 should not be considered limiting especially as to the description of features that loader 200 may have described herein that are not essential to the disclosed embodiments and thus may or may not be included in power machines other than loader 200 upon which the embodiments disclosed below may be advantageously practiced. Unless specifically noted otherwise, embodiments disclosed below can be practiced on a variety of power machines, with the track loader 200 being only one of those power machines. For example, some or all of the concepts discussed below can be practiced on many other types of track work vehicles such as various other loaders, excavators, trenchers, and dozers, to name but a few examples.

Loader 200 includes frame 210 that supports a power system 220, the power system can generate or otherwise providing power for operating various functions on the power machine. Frame 210 also supports a work element in the form of a lift arm structure 230 that is powered by the power system 220 and can perform various work tasks. As loader 200 is a work vehicle, frame 210 also supports a traction system 240, which is also powered by power system 220 and can propel the power machine over a support surface. The lift arm structure 230 in turn supports an implement carrier interface 270, which includes an implement carrier 272 that can receive and securing various implements to the loader 200 for performing various work tasks and power couplers 274, which are provided to selective provide power to an implement that might be connected to the loader. The loader 200 can be operated from within a cab 250 from which an operator can manipulate various control devices 260 to cause the power machine to perform various functions. Cab 250 can be pivoted back about an axis that extends through mounts 254 to access components as needed for maintenance and repair.

Various power machines that can include and/or interacting with the embodiments discussed below can have various different frame components that support various work elements. The elements of frame 210 discussed herein are provided for illustrative purposes and should not be considered to be the only type of frame that a power machine on which the embodiments can be practiced can employ. Frame 210 of loader 200 includes an undercarriage or lower portion 211 of the frame and a mainframe or upper portion 212 of the frame that is supported by the undercarriage. The mainframe 212 of loader 200 is attached to the undercarriage 211 such as with fasteners or by welding the undercarriage to the mainframe. Mainframe 212 includes a pair of upright portions 214A and 214B located on either side and toward the rear of the mainframe that support lift arm structure 230 and to which the lift arm structure 230 is pivotally attached. The lift arm structure 230 is illustratively pinned to each of the upright portions 214A and 214B. The combination of mounting features on the upright portions 214A and 214B and the lift arm structure 230 and mounting hardware (including pins used to pin the lift arm structure to the mainframe 212) are collectively referred to as joints 216A and 216B (one is located on each of the upright portions 214) for the purposes of this discussion. Joints 216A and 216B are aligned along an axis 218 so that the lift arm structure is capable of pivoting, as discussed below, with respect to the frame 210 about axis 218. Other power machines may not include upright portions on either side of the frame or may not have a lift arm structure that is mountable to upright portions on either side and toward the rear of the frame. For example, some power machines may have a single arm, mounted to a single side of the power machine or to a front or rear end of the power machine. Other machines can have a plurality of work elements, including a plurality of lift arms, each of which is mounted to the machine in its own configuration. Frame 210 also supports a pair of tractive elements 219A and 219B on either side of the loader 200, which on loader 200 are track assemblies.

The lift arm structure 230 shown in FIG. 1 is one example of many different types of lift arm structures that can be attached to a power machine such as loader 200 or other power machines on which embodiments of the present discussion can be practiced. The lift arm structure 230 has a pair of lift arms 234 that are disposed on opposing sides of the frame 210. A first end of each of the lift arms 234 is pivotally coupled to the power machine at joints 216 and a second end 232B of each of the lift arms is positioned forward of the frame 210 when in a lowered position as shown in FIG. 2. The lift arm structure 230 is moveable (i.e. the lift arm structure can be raised and lowered) under control of the loader 200 with respect to the frame 210. That movement (i.e. the raising and lowering of the lift arm structure 230) is described by a travel path, shown generally by arrow 237. For the purposes of this discussion, the travel path 237 of the lift arm structure 230 is defined by the path of movement of the second end 232B of the lift arm structure.

Each of the lift arms 234 of lift arm structure 230 as shown in FIG. 2 includes a first portion 234A and a second portion 234B that is pivotally coupled to the first portion 234A. The first portion 234A of each lift arm 234 is pivotally coupled to the frame 210 at one of the joints 216 and the second portion 234B extends from its connection to the first portion 234A to the second end 232B of the lift arm structure 230. The lift arms 234 are each coupled to a cross member 236 that is attached to the first portions 234A. Cross member 236 provides increased structural stability to the lift arm structure 230. A pair of actuators 238, which on loader 200 are hydraulic cylinders configured to receive pressurized fluid from power system 220, are pivotally coupled to both the frame 210 and the lift arms 234 at pivotable joints 238A and 238B, respectively, on either side of the loader 200. The actuators 238 are sometimes referred to individually and collectively as lift cylinders. Actuation (i.e., extension and retraction) of the actuators 238 cause the lift arm structure 230 to pivot about joints 216 and thereby be raised and lowered along a fixed path illustrated by arrow 237. Each of a pair of control links 217 are pivotally mounted to the frame 210 and one of the lift arms 232 on either side of the frame 210. The control links 217 help to define the fixed travel path of the lift arm structure 230. The lift arm structure 230 shown in FIG. 2 is representative of one type of lift arm structure that may be coupled to the power machine 100. Other lift arm structures, with different geometries, components, and arrangements can be pivotally coupled to the loader 200 or other power machines upon which the embodiments discussed herein can be practiced without departing from the scope of the present discussion. For example, other machines can have lift arm structures with lift arms that each has one portion (as opposed to the two portions 234A and 234B of lift arm 234) that is pivotally coupled to a frame at one end with the other end being positioned in front of the frame. Other lift arm structures can have an extendable or telescoping lift arm. Still other lift arm structures can have several (i.e. more than two) portions segments or portions. Some lift arms, most notably lift arms on excavators but also possible on loaders, may have portions that are controllable to pivot with respect to another segment instead of moving in concert (i.e. along a pre-determined path) as is the case in the lift arm structure 230 shown in FIG. 2. Some power machines have lift arm structures with a single lift arm, such as is known in excavators or even some loaders and other power machines. Other power machines can have a plurality of lift arm structures, each being independent of the other(s).

Implement interface 270 is provided at a second end 234B of the arm 234. The implement interface 270 includes an implement carrier 272 that can accept and securing a variety of different implements to the lift arm 230. Such implements have a machine interface that is configured to be engaged with the implement carrier 272. The implement carrier 272 is pivotally mounted to the second end 234B of the arm 234. Implement carrier actuators are operably coupled the lift arm structure 230 and the implement carrier 272 and are operable to rotate the implement carrier with respect to the lift arm structure.

The implement interface 270 also includes an implement power source 274 available for connection to an implement on the lift arm structure 230. The implement power source 274 includes pressurized hydraulic fluid port to which an implement can be coupled. The pressurized hydraulic fluid port selectively provides pressurized hydraulic fluid for powering one or more functions or actuators on an implement. The implement power source can also include an electrical power source for powering electrical actuators and/or an electronic controller on an implement. The implement power source 274 also exemplarily includes electrical conduits that are in communication with a data bus on the excavator 200 to allow communication between a controller on an implement and electronic devices on the loader 200.

The lower frame 211 supports and has attached to it a pair of tractive elements 219A and 219B. Each of the tractive elements 219A and 219B has a track frame that is coupled to the lower frame 211. The track frame supports and is surrounded by an endless track, which rotates under power to propel the loader 200 over a support surface. Various elements are coupled to or otherwise supported by the track frame for engaging and supporting the endless track and cause it to rotate about the track frame. For example, a sprocket is supported by the track frame and engages the endless track to cause the endless track to rotate about the track frame. An idler is held against the track by a tensioner (not shown) to maintain proper tension on the track. The track frame also supports a plurality of rollers, which engage the track and, through the track, the support surface to support and distribute the weight of the loader 200.

Loaders can include human-machine interfaces including display devices that are provided in the cab to give indications of information relatable to the operation of the power machines in a form that can be sensed by an operator, such as, for example audible and/or visual indications. Audible indications can be made in the form of buzzers, bells, and the like or via verbal communication. Visual indications can be made in the form of graphs, lights, icons, gauges, alphanumeric characters, and the like. Displays can provide dedicated indications, such as warning lights or gauges, or dynamic to provide programmable information, including programmable display devices such as monitors of various sizes and capabilities. Display devices can provide diagnostic information, troubleshooting information, instructional information, and various other types of information that assists an operator with operation of the power machine or an implement coupled to the power machine. Other information that may be useful for an operator can also be provided.

The description of power machine 100 and loader 200 above is provided for illustrative purposes, to provide illustrative environments on which the embodiments discussed below can be practiced. While the embodiments discussed can be practiced on a power machine such as is generally described by the power machine 100 shown in the block diagram of FIG. 1 and more particularly on a loader such as track loader 200, unless otherwise noted or recited, the concepts discussed below are not intended to be limited in their application to the environments specifically described above.

Figure 4:
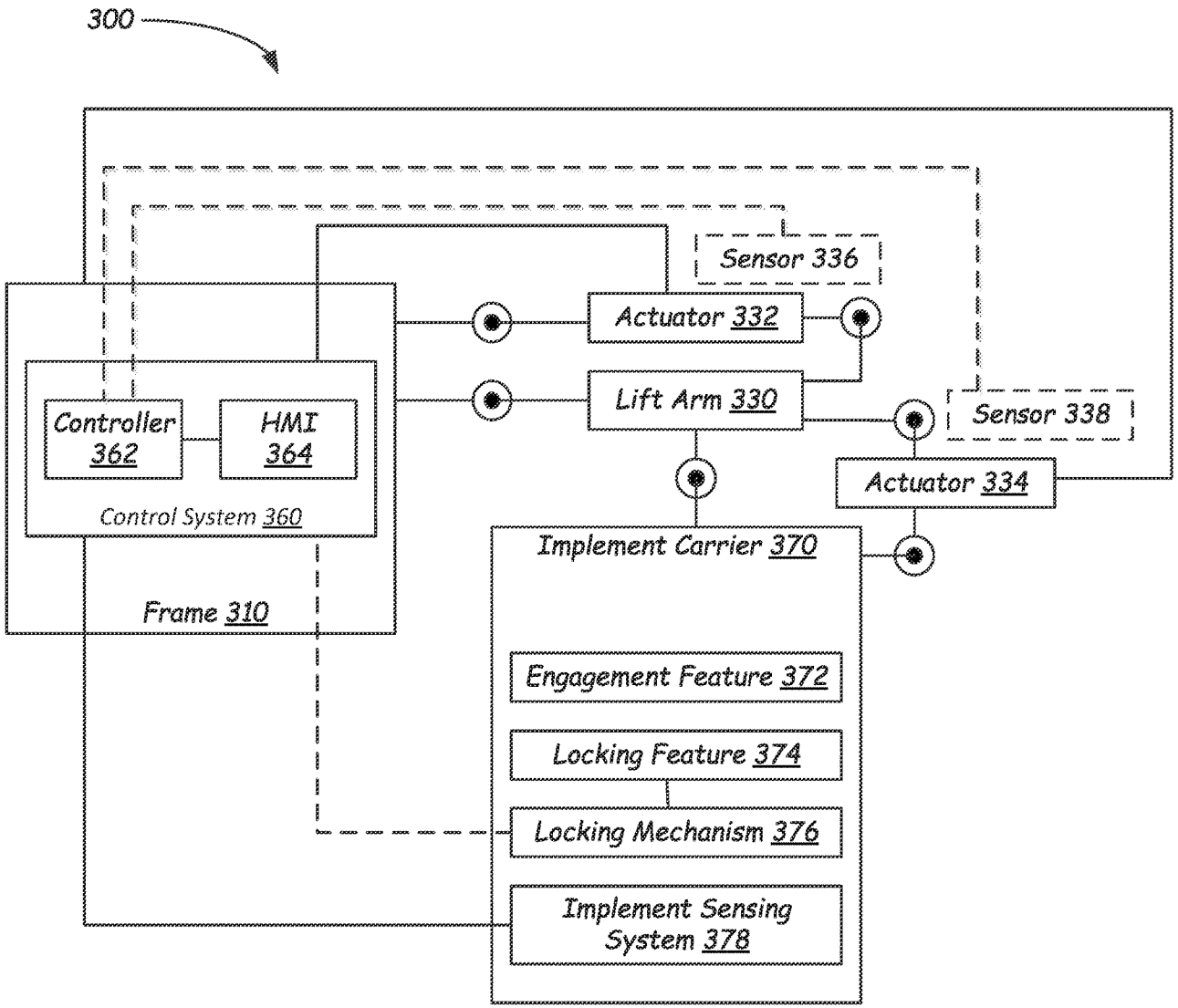
FIG. 4 is a block diagram of a power machine having an implement carrier with an implement sensing system according to one illustrative embodiment.

FIG. 4 is a block diagram that illustrates a power machine 300 having an implement carrier 370 with an implement sensing system 378 according to one illustrative embodiment. The power machine 300 has a frame 310 with a control system 360 operably coupled to the frame. A lift arm 330 is pivotally coupled to the frame and is movable relative to the frame 310 under power of an actuator 332. An implement carrier 370 is pivotally coupled to the lift arm 330 and moveable relative to the lift arm under power of an actuator 334.

Implement carrier 370 includes an engagement feature 372 for engaging an implement while and after the implement is being coupled to the implement carrier. The implement carrier 370 also includes a locking feature 374 that is operable, along with the engagement feature 372, to secure an implement to the implement carrier 370. The locking feature 374 is moveable between an unlocked position and a locked position. A locking mechanism 376 is operable to move the locking feature 374 between the unlocked and the locked position. An implement sensing system 378 is provided to sense whether an implement is in close proximity to the implement carrier.

Control system 360 includes a controller 362 and a human/machine interface (HMI) 364, which is in communication with the controller 362. The HMI 364 includes various manipulable operator input devices such as levers, joysticks, buttons, switches, and the like through which an operator can communicate an intention to control work functions on the power machine 300. Some of these operator input devices, in some embodiments, are mechanical devices that engage hydraulic pumps and/or valves to control machine functions. In some embodiments, at least some of the operator input devices are in communication with the controller 362, which in turn is configured to control various work functions based at least in part by signals provided by the operator input devices to the controller. For example, in some embodiments, the locking mechanism 376 is controlled by the control system 360 in response to manipulation of one or more operator input devices.

In FIG. 4, the actuators 332 and 334 are illustrated as being in communication with the control system 360. In some embodiments, the actuators 332 and 334 are controlled in response to signals from the controller 362. This allows the controller 362 to control movement of the lift arm 330 relative to the frame 310 and control movement of the implement carrier 370 relative to the lift arm 330. In addition, in some embodiments, controller 362 is in communication with sensors 336 and 338 that measure the position or attitude of the lift arm 330 and/or the implement carrier 334, respectively. Various types of sensors can be used to sense the position of the lift arm 330 relative to the frame 310 and the implement carrier 370 relative to the lift arm 330. In addition, some sensors can be used to sense the attitude of the lift arm 330 and/or implement carrier 370 relative to gravity. The implement sensing system 378, in some embodiments, includes one or more proximity sensors that sense when an implement is in close proximity. In some embodiments the proximity sensors are non-contact proximity sensors and in other embodiments they can be contact proximity sensors.

Figure 5:
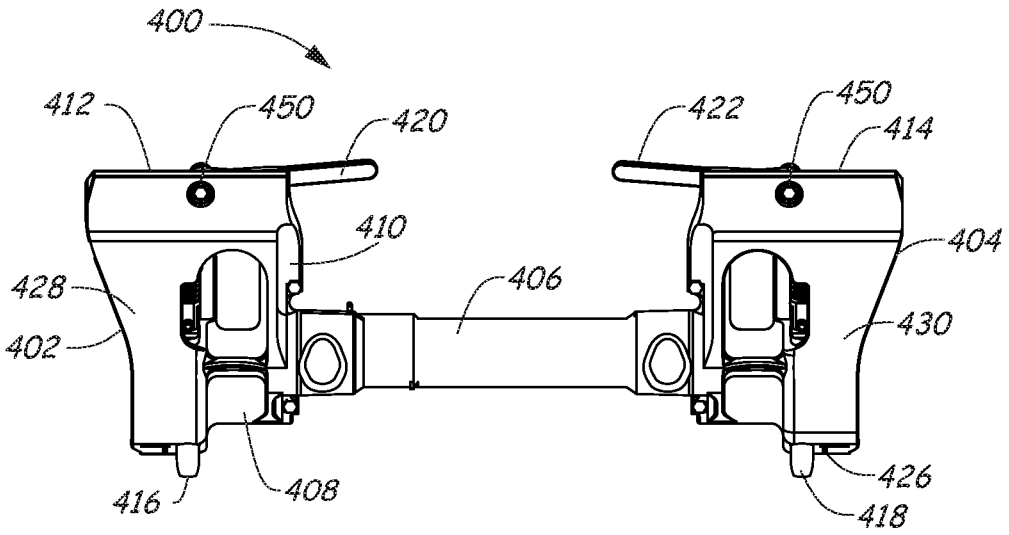
FIG. 5 shows an implement carrier having a sensing system according to one illustrative embodiment.

FIG. 5 illustrates an implement carrier 400 for use on a power machine 300 that is equipped with sensors for sensing the proximity of an implement according to one illustrative embodiment. Implement carrier 400 includes a first plate 402 and a second plate 404 that are configured for engaging an implement. Each of the first plate 402 and the second plate 404 are coupled together such as by cross tube 406. In other embodiments, a single plate extends along a length of the implement carrier. The first plate 402 and second plate 404 are substantially mirror images of each other such that the components identified and discussed directly below on the first plate 402 are similar on the second plate 404. First plate 402 includes a lift arm interface member 408 that is coupled to the cross tube 406. The lift arm interface member 408 includes a bushing that is configured to accept a pin to rotatably couple the implement carrier 400 to a lift arm. A bushing 410 is also coupled to the cross tube 406. A tilt actuator (not shown) can be pinned to the bushing 410 to rotatably couple the tilt actuator to the implement carrier 400.

The first plate 402 and second plate 404 includes engagement features 412 and 414 each of which is configured to engage a complementary feature on an implement. The engagement features 412 and 414 angle forward from front faces 428 and 430, respectively of the first and second plates 402 and 404. As the engagement features 412 and 414 engage an implement, an operator will rotate the implement carrier 400 backward and/or raise the lift arm to lift the implement onto the implement carrier. The implement, when engaged by the engagement features 412 and 414 will tend to rotate the implement toward the first and second plates.

The first and second plates 402 and 404 each also includes locking features 416 and 418 in the form of pins that are moveable between a locked position (as shown in FIG. 5) and an unlocked position, where the pins are retracted. The pins 416 and 418 are each operably coupled to handles 420 and 422 that are rotatable about pivots 450 to extend and retract the pins. The locking mechanism handles are manually rotated between an engaged position (shown in FIG. 5) and a disengaged position (not shown). In some embodiments, an actuator such as a hydraulic cylinder (not shown) can be operably coupled to the handles to manipulate the handles between the engaged and disengaged position or otherwise manipulate mechanisms to extend and retract the pins.

The implement carrier 400 also includes a first sensor 424 (shown in FIGS. 11 and 13-15 that is positioned on the first face 402 near the engagement feature 412 and a second sensor 426 positioned on the second face 404 near the pin 418. By "near the engagement feature 412," it is meant that the first sensor 424 is located near a top of the first plate 402 and "by near the pin 418," it is meant that the second sensor 426 is located near a bottom of the second plate 404. The first sensor 424 is configured so that it will not sense the presence of an implement unless the engagement features 412 and 414 have engaged the implement and drawn it close to the implement carrier. The second sensor 426 is configured so that it will not sense the presence of an implement unless the implement is positioned to allow the pin 418 to engage and secure the implement to the implement carrier. While the sensors are illustrated on opposite sides of the implement carrier (in this case on opposite plates), in other embodiments the sensors can be on the same side or same plate of the implement carrier. In some embodiments, the first and second sensors are non-contact proximity sensors of any suitable type. In other embodiments, either or both of the first and second sensors can incorporate a contact-type sensor including a plunger or other actuation mechanism that is actuable under contact between the sensor and an implement. While the discussion above and FIG. 5 illustrates a single sensor (i.e., the first sensor 424) near the engagement features and a single sensor (i.e. the second sensor 426) near the pin 418 to sense the presence of an object (i.e., an implement), in some embodiments additional sensors can be included. For example, in some embodiments an additional proximity sensor can be positioned near pin 416 (not shown in FIG. 5). Alternatively, or in addition, an additional proximity sensor can be positioned near engagement feature 414 (not shown in FIG. 5). Either or both of these additional sensors can provide additional information about the positioning of an implement relative to an implement carrier. In some embodiments, a sensor (not shown) is provided to sense whether one or more pins is extended or retracted.

Figure 8:
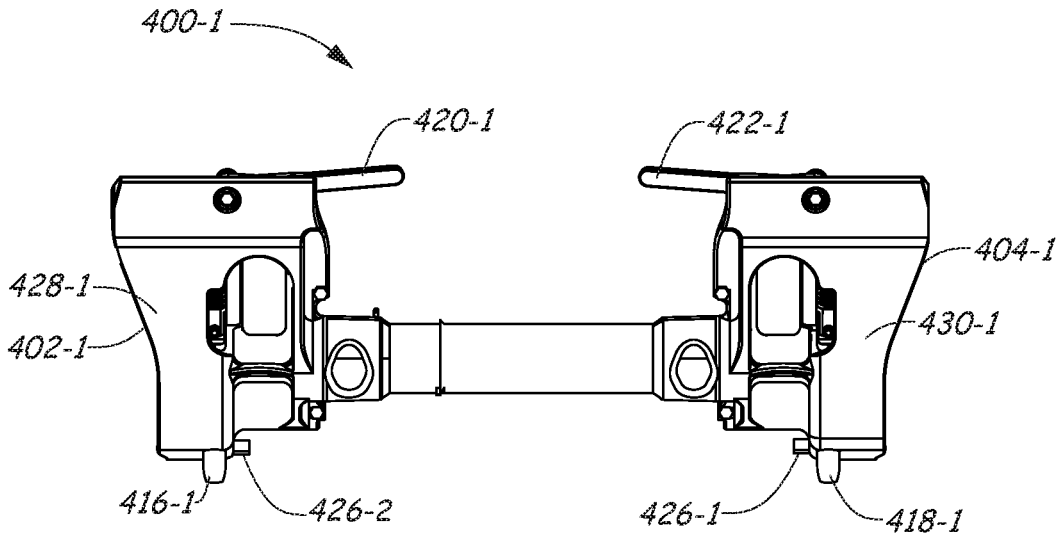
FIG. 8 shows an alternative implement carrier having a sensing system according to an illustrative embodiment.

Further, while FIG. 5 illustrates sensor 426 outboard or outward of pin 418, in other embodiments, sensor 426 can be located inboard or inward of pin 418. For example, referring to FIG. 8, shown is an implement carrier 400-1 for use on a power machine 300. Implement carrier 400-1 has features similar to, or the same as, features discussed above for implement carrier 400, and an illustrative sample of those features are similarly numbered in FIG. 8. Features not specifically numbered or discussed can be the same as discussed above with reference to implement carrier 400. As can be seen in FIG. 8, with implement carrier 400-1, sensor 426-1 is positioned inboard of pin 416-1 in this embodiment.

Figure 9:
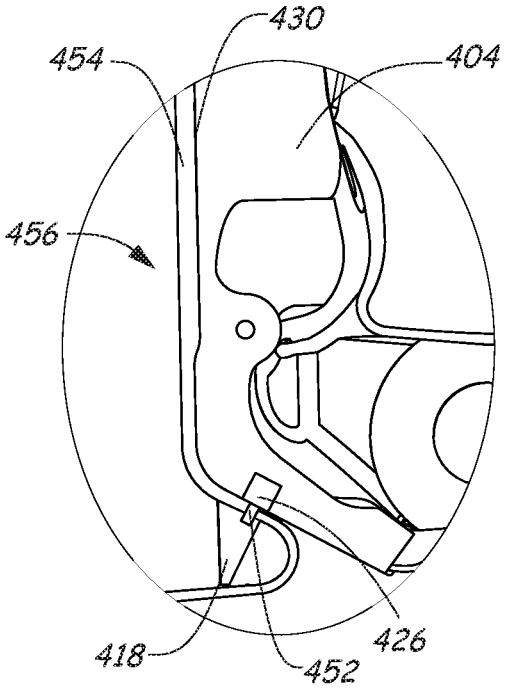
FIGS. 9 and 10 illustrate a portion of the implement carrier shown in FIG. 5, illustrating an example placement of a first sensor for sensing implement interface placement.
Figure 10:
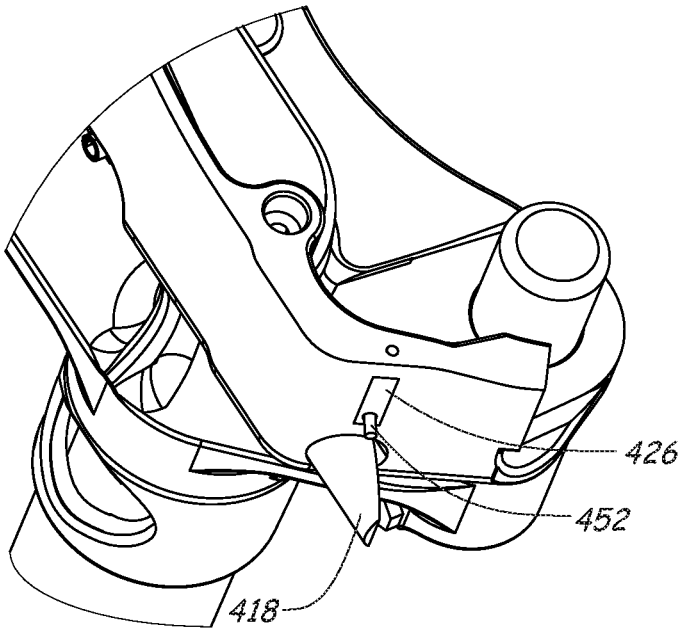

Referring now to FIGS. 9 and 10, shown is sensor 426 configured to detect the presence of implement carrier interface 454 (shown in FIG. 9) of an attached implement 456 in a region 452 in which the implement carrier interface 454 is positioned to allow pin 418 to be extended into the implement carrier interface. In FIG. 10, the attached implement 456 is not shown, but pin 418 is shown in its extended or locked position. As noted above, for alternate embodiments such as implement carrier 400-1, sensor 426 would be positioned inboard of pin 418 instead of outboard.

Figure 11:
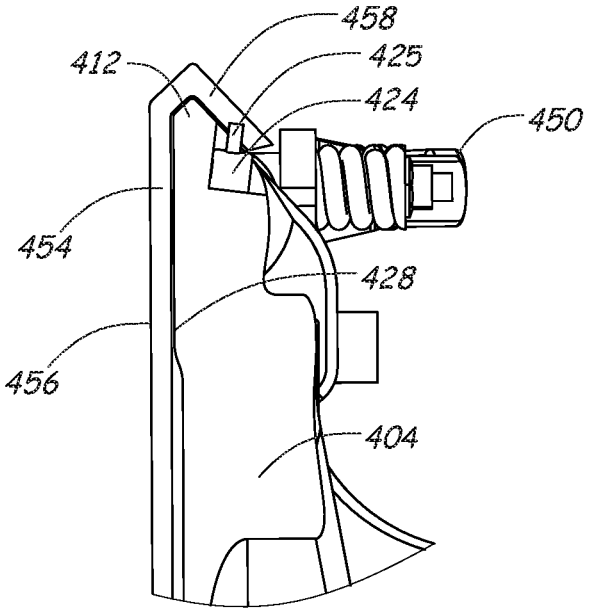
FIG. 11 illustrates another portion of the implement carrier shown in FIG. 5, illustrating an example placement of a second sensor for sensing implement interface placement.

Referring now to FIG. 11, shown is a diagrammatic side view of second plate 404 with implement carrier interface 454 of attached implement 456 positioned against face 428 of the second plate 404. Lip 458 of the implement carrier interface 454 of the implement is engaged with engagement feature 412 of plate 402. Sensor 424 is positioned near pivot 450 of handle 420 (not shown in FIG. 11) and near engagement feature 412. As such, sensor 424 is positioned to sense the presence of an object (i.e. the implement) near the engagement feature 412 as discussed above.

Figure 12:
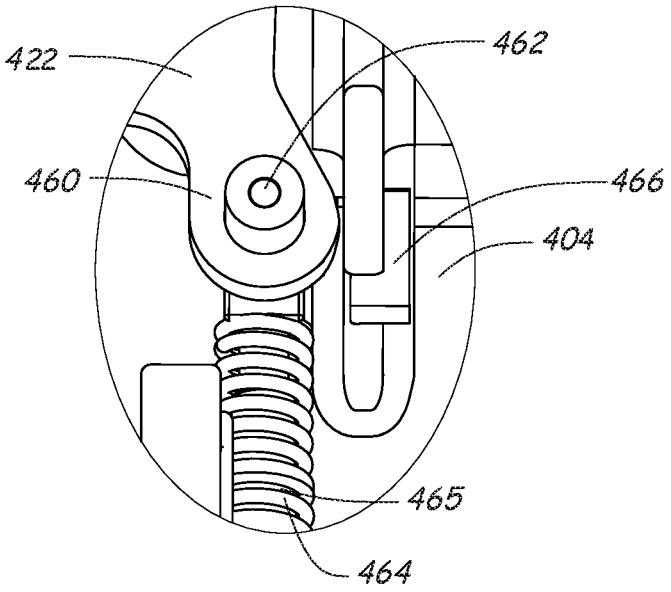
FIGS. 12-15 illustrate portions of the implement carrier shown in FIG. 5, illustrating an example placement of a sensor for sensing a position of a locking handle.
Figure 13:
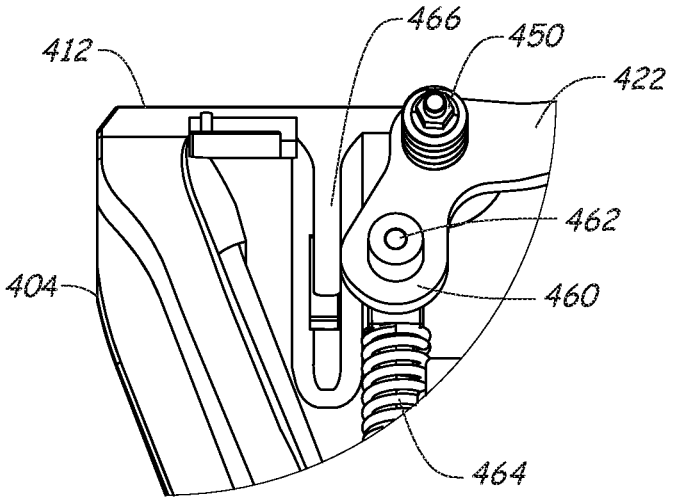
Figure 14:
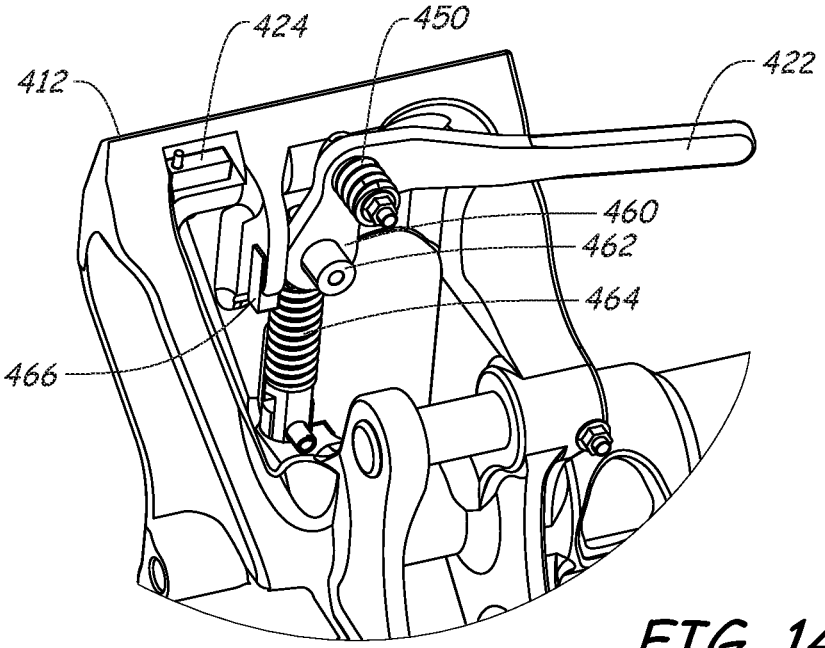
Figure 15:
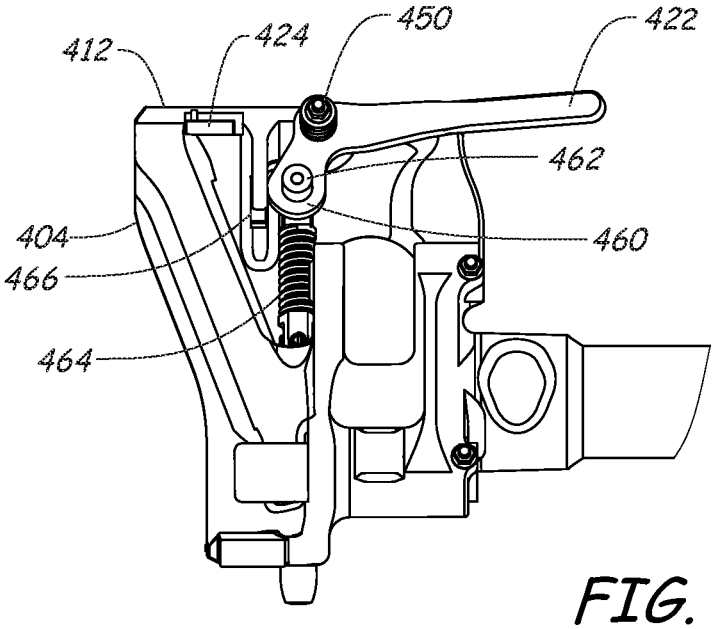

Referring now to FIGS. 12-15, illustrated are portions of first plate 402 (in FIG. 12) and second plate 404 (in FIGS. 13-15) of implement carrier 400 showing further features of some disclosed embodiments. As shown in FIG. 12, handle 420 is rotatably attached to the plate 402 by a pivot connection 450 (shown in FIG. 5). Likewise, handle 422 is rotatably attached to the plate 404 by a pivot connection 450 (shown in FIG. 13). Each handle 420 and 422 has a plunger 465 is connected to it at a joint 462 and although not shown, a portion of the plunger 465 is movable with respect to each of the handles 420 and 422. A spring 462 biases each plunger 465 in a downward direction. As the handles 420 and 422 rotate between a raised and lowered position, a portion 460 of the handles moves away from, or toward sensor 466. When either of handles 420 and 422 are raised, the sensor 466 associated with respective handle does not sense portion 460. However, when the handles 420 and 422 are lowered, as is shown in each FIGS. 12-13, sensor 466 will sense portion 460.

Figure 16:
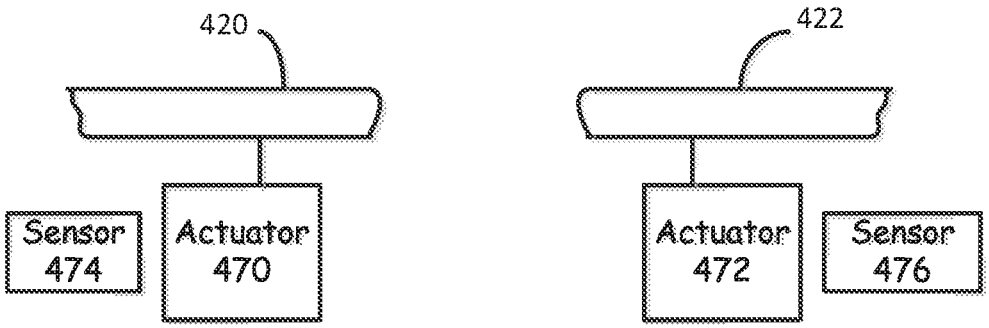
FIG. 16 illustrates an alternate embodiment with actuator powered locking handles and sensors placed to sense positions of the actuators to thereby detect handle positions.

The handles 420 and 422 can be manually rotated to engage locking features 416 and 418 with a properly placed implement. However, locking features 416 and 418 can also be raised and lowered under power by actuators coupled to the handles. For example, U.S. Pat. No. 5,562,397 entitled Power Actuator for Attachment Plate, which is herein incorporated by reference in its entirety, provides an example of such a powered configuration for moving the handles and locking mechanisms. With a power actuator configured handle arrangement, sensor 466 could instead be replaced with a sensor 474 positioned to sense a position of the actuator 470 coupled to the handle 420 as shown in FIG. 16. Likewise, a second sensor 476 can be positioned to sense a position of an actuator 472 coupled to handle 422. In general, some exemplary embodiments include at least one sensor positioned to provide an output indicative of a position of a locking handle or lever on an implement carrier. The embodiments can include sensors for each of two handles or levers, and/or can include multiple sensors per handle or lever to provide accurate indication of the position of the handle or actuator(s) coupled to the handle.

Figure 6:
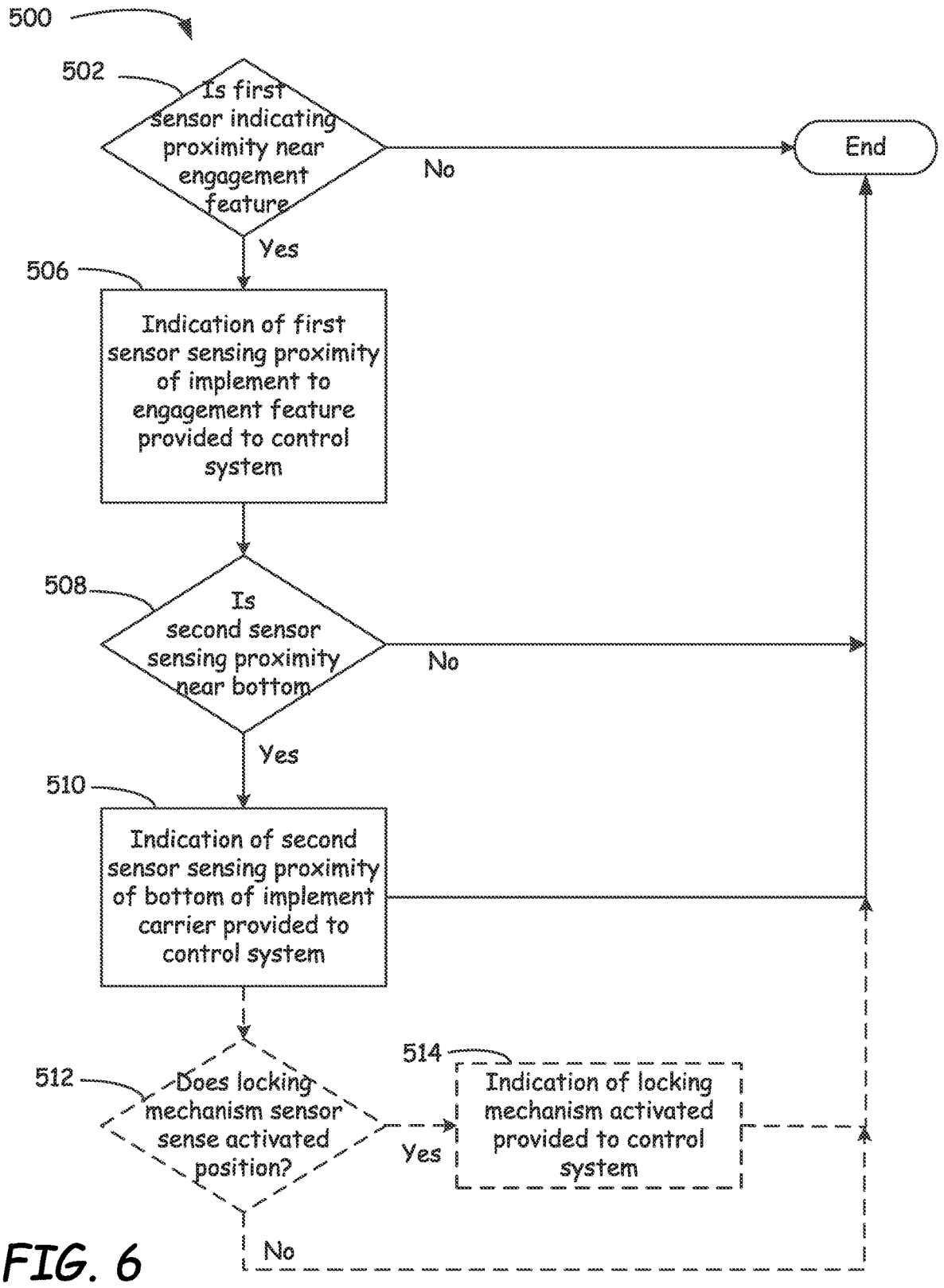
FIG. 6 is a functional block diagram illustrating a method of sensing whether an implement is properly positioned relative to an implement carrier according to one illustrative embodiment.

FIG. 6 illustrates a method 500 of sensing whether an implement is in close enough proximity to an implement carrier that it can be operably coupled to the implement carrier according to one illustrative embodiment. The method 500 includes sensing the position of an implement and providing an indication of the position to an operator. Method 500 can be better understood by referencing the block diagram in FIG. 6 as well as the illustrations in FIGS. 4-5. The method begins at block 502 where an implement sensing system detects whether a first sensor, such as sensor 424 senses the presence of an object (i.e. an implement) near the engagement feature of an implement carrier (or, in the alternative, at one position on the implement carrier). In some embodiments, the first sensor of block 502 refers to a single sensor such as sensor 424. In other embodiments, the determination of the state of a "first sensor" includes a determination of the states of more than one sensor, such as when a second sensor is laterally spaced apart from sensor 424. If it is determined at block 502 that the first sensor does not detect the presence of an object, the method can end or begin again.

If, however, at block 502, the first sensor detects a presence of an object proximal to the engagement feature, at block 506 an indication of the first sensor sensing proximity of an object (i.e. an implement) proximal to the engagement feature is provided to the control system 360 and to the operator via the HMI 364. The method then moves to block 508, where it is determined whether a second sensor such as sensor 426 (or a combination of sensors, as discussed above with respect to the first sensor) senses an object in close proximity to the bottom of an implement carrier (or alternatively, to a second position on the implement carrier). If no object is sensed by the second sensor, the method can again end or begin again. If, however, at block 508, the second sensor senses the proximity of an object, the method moves to block 510, and an indication of the second sensor sensing proximity of an object (i.e. an implement) proximal to the engagement feature is provided to the control system 360 and to the operator via the HMI 364. In some embodiments, this constitutes the end of the method 500. In other embodiments, as discussed below, the method 500 includes additional blocks 512 and 514.

The method 500 as shown in FIG. 6 illustrates a serial path for determination of the status of the first and second sensors. That is, unless the first sensor indicates the presence of an object, the status of the second sensor is not determined. This can reflect, in some embodiments, that an implement carrier, to be properly secured to an implement, necessarily needs to have the implement sensed by the first sensor first, if only for a brief moment in time. However, it should be appreciated that that need not be the case in all embodiments and that in some methods of detection, the order of detecting the presence of an object (i.e. first sensor and then the second, or vice versa) may not be important.

As mentioned briefly above, in some embodiments, the method 500 can further include sensing the position of a locking mechanism such as the wedges 416 and 418. At block 512, the method determines whether a locking mechanism sensor is in an activated position. For example, with the implement carrier 400, such as sensor would detect whether one or more of the levers 420 and 422 are rotated in the activated position (the position shown in FIG. 5), whether the pins 416 and/or 418 are extended as shown in FIG. 5, and/or whether the pins 416 and/or 418 are extended into a receiving structure on an implement. If it is determined at block 512 that the locking mechanism is in an activated position, however that is defined, the method moves to block 514 and an indication of the locking mechanism being in an actuated position is provided to the control system 360.

Figure 7:
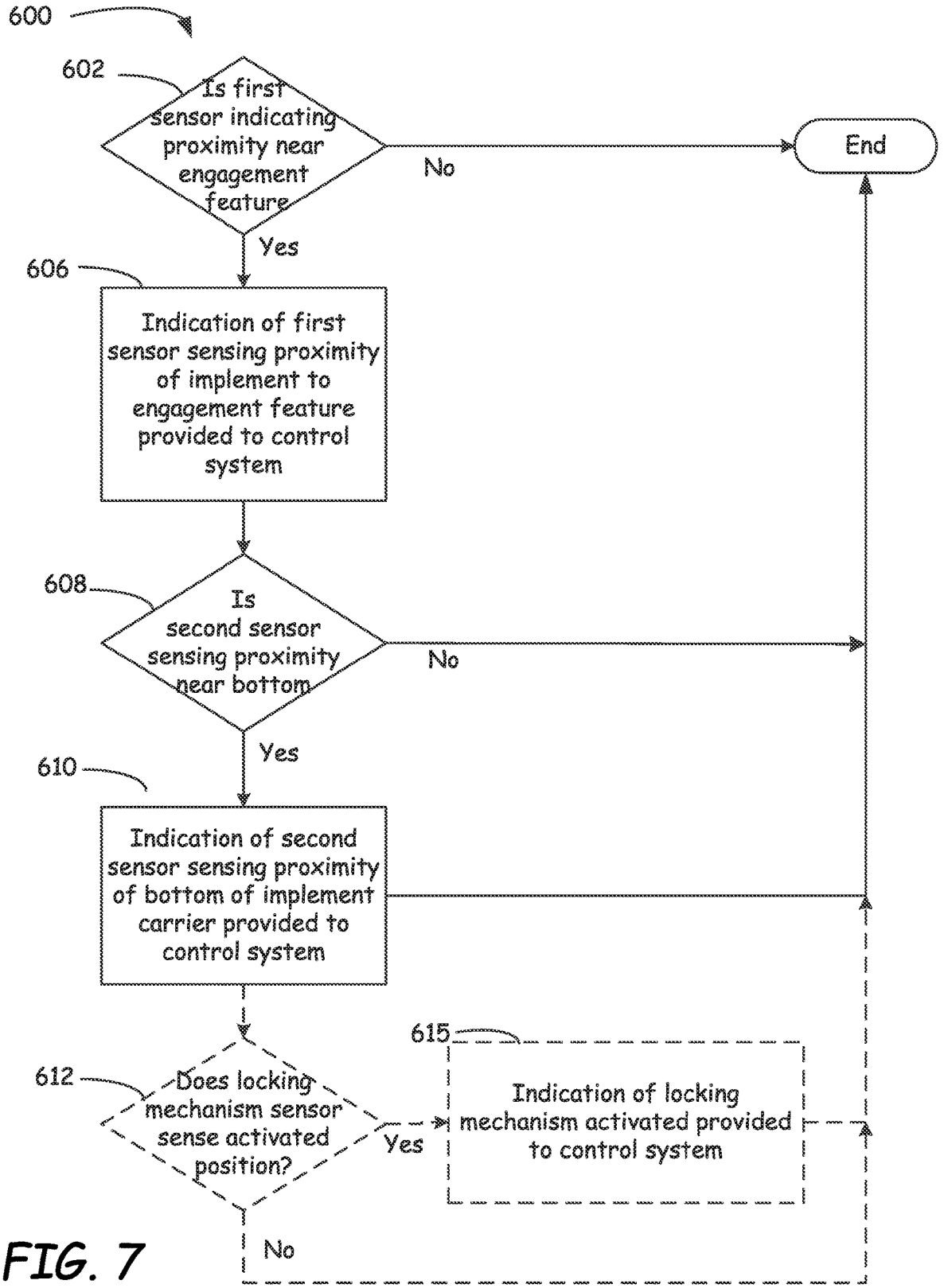
FIG. 7 is a functional block diagram illustrating a method of sensing whether an implement is properly positioned related to an implement carrier according to another illustrative embodiment.

FIG. 7 illustrates a method 600 of sensing whether an implement is in close enough proximity to an implement carrier that it can be operably coupled to the implement carrier according to another illustrative embodiment. Method 600 includes sensing the position of an implement and providing an indication of the position to an operator. Method 600 can be better understood by referencing the block diagram 7 as well as FIGS. 4-5. In some instances, method 600 is similar to method 500. For example, references to a first sensor can include more than one sensor. Blocks in the method 600 that are substantially similar to method 500 are similarly numbered to those in method 500. For example, block 602 is similar to block 502.

The method begins at block 602, where an implement sensing system detects whether a first sensor detects an object near the engagement feature or some other position on the implement carrier. If it is determined that the first sensor does not detect the presence of an object, the method ends or begins again.

If, however, it is determined at block 602 that the first sensor detects a presence of an object proximal to the engagement feature, at block 606 an indication of the first sensor sensing proximity of an object (i.e. an implement) proximal to the engagement feature is provided to the control system and to the operator via the HMI. The method then moves to block 608, where it is determined whether a second sensor senses an object in close proximity to the bottom of an implement carrier (or alternatively, to a second position on the implement carrier). In embodiments disclosed above, the second position at the bottom of the implement carrier can include two sensors that sense whether the implement is in close proximity to the bottom of implement carrier in two different locations. If both sensors are not indicating that the implement is in close proximity to the bottom of the implement sensor, the object (i.e., the implement) is not considered to be in close proximity. If no object is sensed by the second sensor, the method ends or begins again.

If, however, at block 608, the second sensor senses the proximity of an object, the method moves to block 610, and an indication of the second sensor sensing proximity of an object (i.e. an implement) proximal to the engagement feature is provided to the control system and to the operator via the HMI. In some embodiments, this constitutes the end of the method 600. In other embodiments, as discussed below, the method 600 includes additional blocks 612 and 615.

The method 600 as shown in FIG. 6 illustrates a serial path for determination of the status of the first and second sensors. That is, unless the first sensor indicates the presence of an object, the status of the second sensor is not determined. This can reflect, in some embodiments, that an implement carrier, to be properly secured to an implement, necessarily needs to have the implement sensed by the first sensor first, if only for a brief moment in time. However, it should be appreciated that that need not be the case in all embodiments and that in some methods of detection, the order of detecting the presence of an object (i.e. first sensor and then the second, or vice versa) may not be important.

As mentioned briefly above, in some embodiments, the method 600 can further include sensing the position of a locking mechanism such as the handles 420 and 422. At block 612, the method determines whether a locking mechanism sensor is in an activated position. For example, with the implement carrier 400, a sensor would detect whether one or more of the levers 420 and 422 are rotated in the activated position (the position shown in FIG. 5), whether the pins 416 and/or 418 are extended as shown in FIG. 5, and/or whether the pins 416 and/or 418 are extended into a receiving structure on an implement. If it is determined at block 612 that the locking mechanism is in an activated position, however that is defined, the method moves to block 615 and an indication of the locking mechanism being in an actuated position is provided to the control system 360 and to the operated via the HMI.

The systems and methods discussed above provide some important advantages. By sensing the proximity of an implement to various positions on an implement carrier, an operator can be informed as to whether an implement is properly positioned relative to an implement carrier. This information will provide an operator with knowledge that the implement can be secured to implement carrier by activating a locking mechanism.

Although the present invention has been described with reference to preferred embodiments, workers skilled in the art will recognize that changes may be made in form and detail without departing from the spirit and scope of the invention.

What is claimed is:

1. A method of sensing a position of an implement relative to an implement carrier of a power machine to which the implement can be attached, the implement carrier having a first plate coupled to a first arm of a lift arm structure and a second plate coupled to a second arm of the lift arm structure, the first and second plates each having a front face, a top surface angled with respect to the front face, and a bottom surface angled with respect to the front face, the method comprising:

determining whether a first sensor of an implement sensing system, located at a first position at the top surface of the first plate of the implement carrier, angled with respect to the front face of the first plate, during a process of beginning engagement with the implement, detects the implement, the first position on the implement carrier being separate from one or more pin engagement positions;

providing an indication to a control system of whether the first sensor detects the implement;

determining whether a second sensor of the implement sensing system, located at a second position at the bottom surface of the second plate of the implement carrier, angled with respect to the front face of the second plate, during the process of beginning engagement with the implement, detects the implement, the second position on the implement carrier being separate from the one or more pin engagement positions;

providing an indication to the control system of whether the second sensor detects the implement;

determining, if the second sensor detected the implement, whether a locking mechanism sensor of the implement sensing system detects a locking mechanism in an activated position; and providing an indication to the control system of whether the locking mechanism is activated.

2. The method of claim 1, wherein the first plate of the implement carrier has a first engagement feature at the top surface, wherein the first engagement feature and the first position of the first sensor are not on the front face of the first plate of the implement carrier, and wherein determining whether the first sensor detects the implement further comprises determining whether the first sensor detects the implement at the position of the first engagement feature at the top surface of the first plate of the implement carrier during the process of beginning engagement with the implement.

3. The method of claim 2, wherein determining whether the first sensor detects the implement at the position of the first engagement feature at the top surface of the first plate during the process of beginning engagement with the implement comprises determining whether the first sensor detects the implement at the position of the first engagement feature that is configured to engage a complementary feature on the implement that can be sensed by the first sensor.

4. The method of claim 3, wherein determining whether the second sensor of the implement sensing system detects the implement further comprises determining whether the second sensor detects the implement at the second position during the process of beginning engagement with the implement such that the front face of the implement carrier is positioned against an implement carrier interface of the implement during the process of beginning engagement with the implement.

5. The method of claim 4, wherein determining whether the locking mechanism sensor of the implement sensing system detects the locking mechanism in the activated position comprises sensing whether a handle of the implement carrier is in a position that moves a coupled pin of the implement carrier to an extended position.

6. The method of claim 4, wherein determining whether the locking mechanism sensor of the implement sensing system detects the locking mechanism in the activated position comprises sensing whether a position or state of an actuator coupled to a handle of the implement carrier is indicative of a handle position that moves a coupled pin of the implement carrier to an extended position.

7. A power machine comprising:

a frame;

a power system configured to provide power for operating functions on the power machine;

a traction system coupled to the frame and configured to move the power machine over a support surface;

a lift arm structure pivotally coupled to the frame and configured to be moved relative to the frame by at least one lift arm actuator, the lift arm structure having first and second arms disposed on first and second opposing sides of a frame of the power machine;

an implement carrier having first and second sides pivotally coupled respectively to the first and second arms of the lift arm structure and configured to be rotated relative to the lift arm structure by at least one implement carrier actuator, wherein the implement carrier includes a front face, a top surface angled with respect to the front face, and a bottom surface angled with respect to the front face, the implement carrier including an engagement feature for engaging an implement while and after the implement is being coupled to the implement carrier, the implement carrier configured such that the engagement feature is at a top portion of the implement carrier during a process of beginning engagement with the implement, the implement carrier further comprising a locking feature that is moveable between an unlocked position and a locked position to, along with the engagement feature, secure the implement to the implement carrier, and a locking mechanism operable to move the locking feature between the unlocked and the locked position;

a control system coupled to the power system and configured to control the provision of power from the power system, the control system including a controller and a human machine interface; and an implement sensing system coupled to the control system and configured to sense whether the implement is in proximity to the implement carrier that the implement can be operably coupled to the implement carrier and to provide indications to the control system, wherein the implement sensing system includes:

a first sensor positioned at a first position on the top surface, angled with respect to the front face, adjacent the engagement feature on the first side of the implement carrier during the process of beginning engagement with the implement and separately from a pin engagement position where a pin of the implement carrier or implement is configured to be engaged by the other of the implement or implement carrier;

a second sensor positioned at a second position on the bottom surface, angled with respect to the front face, the second side of the implement carrier;

wherein the implement sensing system is further configured to:

determine whether the first sensor detects the implement at the first position on the top surface of the first side of the first implement carrier;

provide an indication to the control system of the first sensor sensing proximity of the implement if it is determined that the first sensor does detect the implement;

determine whether the second sensor detects the implement at the second position on the bottom surface of the second side of the implement carrier; and provide an indication to the control system of the second sensor sensing proximity of the implement at the second position on the bottom surface of the second side of the implement carrier if it is determined that the second sensor detects the implement at the second position, the control system configured to responsively control the power machine.

8. The power machine of claim 7, wherein the implement sensing system further includes a locking mechanism sensor and is further configured to:

determine, if the second sensor detected the implement at the second position, whether the locking mechanism sensor detects the locking mechanism in an activated position; and provide an indication to the control system of whether the locking mechanism is activated.

9. The power machine of claim 7, wherein the implement carrier comprises first and second plates respectively providing the first and second sides of the implement carrier, wherein the first position of the first sensor is at a top surface of the first plate, angled with respect to a front face of the first plate, and wherein the second position of the second sensor is at a bottom surface of the second plate, angled with respect to a front face of the second plate.

10. A power machine comprising:

a frame;

a power system configured to provide power for operating functions on the power machine;

a traction system coupled to the frame and configured to move the power machine over a support surface;

a lift arm structure pivotally coupled to the frame and configured to be moved relative to the frame by at least one lift arm actuator;

an implement carrier pivotally coupled to the lift arm structure and configured to be rotated relative to the lift arm structure by at least one implement carrier actuator, the implement carrier including a front face configured to be positioned in contact with an implement carrier interface of the implement when the implement is coupled to the implement carrier, a top surface angled with respect to the front face, and a bottom surface angled with respect to the front face, wherein the implement carrier further includes an engagement feature for engaging an implement while and after the implement is being coupled to the implement carrier, the implement carrier configured such that the engagement feature is at a top portion of the implement carrier during a process of beginning engagement with the implement, the implement carrier further comprising a locking mechanism that is operably coupled to a pin such that when the locking mechanism is operated the pin is caused to move relative to the implement between a disengagement position and an engagement position to secure the implement to the implement carrier;

a control system coupled to the power system and configured to control the provision of power from the power system, the control system including a controller and a human machine interface;

an implement sensing system coupled to the control system and configured to sense whether the implement is in proximity to the implement carrier that the implement can be operably coupled to the implement carrier and to provide indications to the control system of the implement proximity to the implement carrier, the implement sensing system comprising:

a first sensor positioned at a first position on the top surface of the implement carrier during the process of beginning engagement with the implement, and configured to detect presence of the implement;

a second sensor positioned at a second position on the bottom surface of the implement carrier and configured to detect presence of the implement;

a third sensor configured to detect movement of the locking mechanism to allow the control system to control operation of the locking mechanism and resulting movement of the pin between the disengagement position and the engagement position only if the first and second sensors detect presence of the implement.

11. The power machine of claim 10, wherein the first position of the first sensor is at the top surface of the implement carrier on a first side of the implement carrier, and wherein the second position of the second sensor is at the bottom surface of a second side of the implement carrier, the first and second sides of the implement carrier being laterally spaced between first and second sides of the power machine.

12. The power machine of claim 11, wherein the implement carrier comprises first and second plates respectively providing the front face on the first and second sides of the implement carrier, wherein the first position of the first sensor is at a top surface of the first plate, and wherein the second position of the second sensor is at a bottom surface of the second plate.

* * * * *